United States Patent [19]

Newkirk et al.

[11] 4,127,490

[45] Nov. 28, 1978

[54] FIBER FINISH COMPOSITIONS

[75] Inventors: David D. Newkirk, Woodhaven; Basil Thir, Wyandotte; Robert B. Login, Woodhaven, all of Mich.

[73] Assignee: BASF Wyandotte Corporation, Wyandotte, Mich.

[21] Appl. No.: 857,425

[22] Filed: Dec. 5, 1977

[51] Int. Cl.[2] ..... D06M 13/18

[52] U.S. Cl. ..... 252/8.9; 252/8.6; 252/52 A; 428/395

[58] Field of Search ..... 252/8.9, 8.6, 52 A; 428/395

[56] References Cited

U.S. PATENT DOCUMENTS

| | | | |
|---|---|---|---|
| 3,397,081 | 8/1968 | Mayberry | 428/395 |
| 3,687,721 | 8/1972 | Dardoufas | 252/8.9 |
| 3,751,375 | 8/1973 | Bender et al. | 260/45.95 H |
| 3,919,097 | 11/1975 | Park | 252/8.9 |
| 3,925,588 | 12/1975 | Marshall et al. | 428/395 |

*Primary Examiner*—William E. Schulz

*Attorney, Agent, or Firm*—Andrew E. Pierce; Bernhard R. Swick; Robert E. Dunn

[57] ABSTRACT

A textile treating composition, consisting of a mixture of a major amount of lubricant and a minor amount of a stabilizer of said lubricant and a process for employment thereof.

18 Claims, 1 Drawing Figure

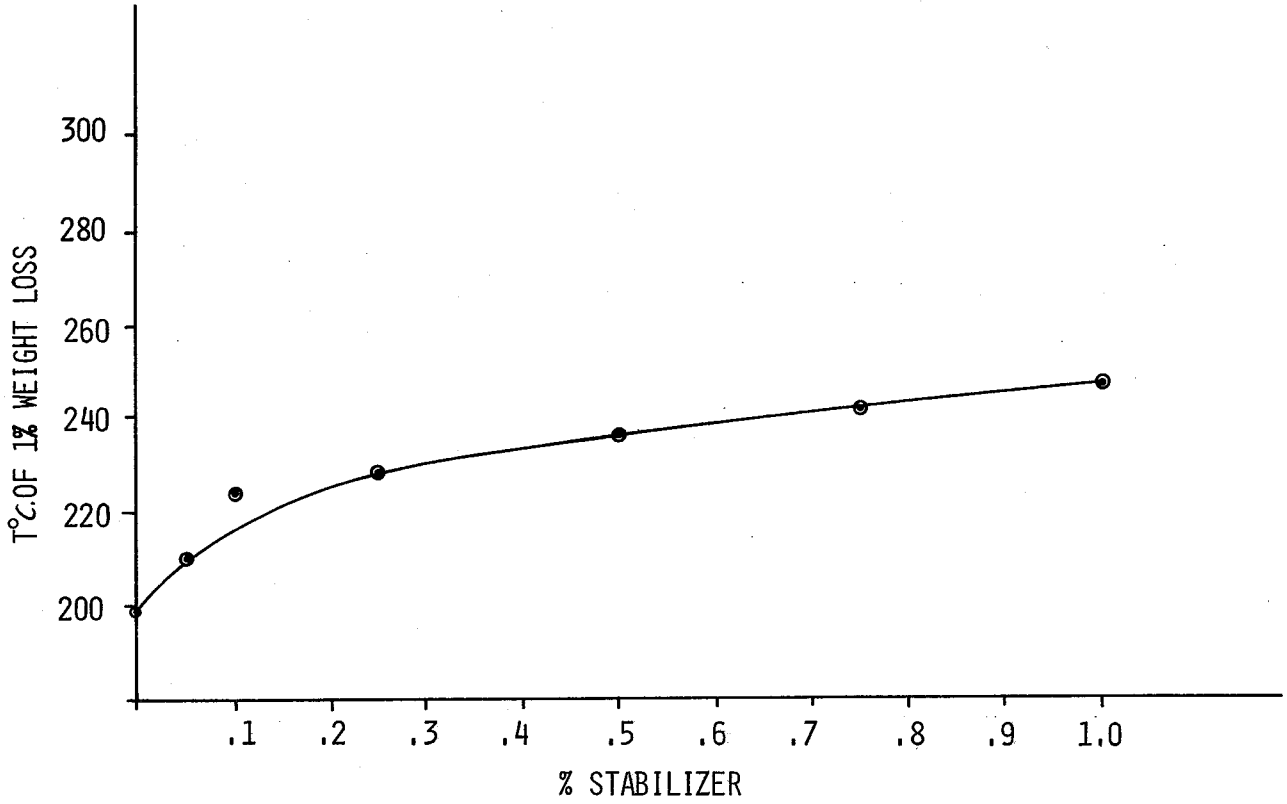
300
280
260
240
220
200
T°C.OF 1% WEIGHT LOSS
.1
.2
.3
.4
.5
.6
.7
.8
.9
1.0
% STABILIZER

FIBER FINISH COMPOSITIONS

BACKGROUND OF THE INVENTION

1. Field of the Invention

This invention relates to improved textile treating compositions and to a process for employment, characterized by said compositions sufficiently stable to prevent oxidative oxidation or degredation at temperatures in excess of 200° C. More particularly, this invention relates to a textile treating composition which is suitable as a textile treating composition consisting of a major amount of a lubricant and an effective amount of stabilizer, said stabilizer being a reaction product of dicyclopentadiene, p-cresol, and isobutylene.

2. Description of the Prior Art

A fiber lubricant which is used as a fiber finish has several functions. It must protect the newly spun fiber from fusion or breakage by controlling the yarn to metal friction between the yarn and machine guides, rollers, draw plates, heater plate and texturing false twist spindles or friction disks. The lubricant provides for yarn cohesion giving strength to the yarn by holding the yarn bundle together and by allowing the yarn to build up an acceptable package at the end of processing. Static electricity that is formed as the yarn rapidly moves through the processing equipment would also be controlled. Finally, the finish must protect machine surfaces from wear. Since the fiber is exposed to heat treatment during processing steps such as bulking and texturing, the fiber lubricant must show acceptable thermal stability in air. Generally, fiber lubricants consisted of a base material such as mineral oils, alkylesters of fatty acids or vegetable oils; emulsifiers that allowed the lubricant to be applied from a water solution; and antistatic agents. Furthermore, special additives such as antioxidants, bactericides, friction modifiers or buffering agents were added. U.S. Pat. Nos. 3,785,973, 3,951,825, and British Pat. No. 1,440,552 teach the texturizing of polyesters. U.S. Pat. No. 3,925,588 teaches a fiber finish for polyesters employing a particular phenolic compound as an antioxidant. U.S. Pat. No. 3,397,081 teaches the production of nylon fiber using a finish lubricant which contains an antioxidant formed by the reaction of diphenylamine and acetone.

SUMMARY OF THE INVENTION

In accordance with the present invention there is provided a textile treating composition which consists of a major amount of a lubricant and a minor effective amount of stabilizer sufficient to prevent the oxidative decomposition of said lubricant.

BRIEF DESCRIPTION OF THE DRAWING

The graph illustrates the oxidative stability of a textile treating composition in air containing various concentrations of stabilizer.

DESCRIPTION OF THE PREFERRED EMBODIMENTS

In a preferred embodiment of this invention there is provided a synthetic polyamide or polyester textile treating composition which consists of a mixture of (1) a major amount of a lubricant and (2) a minor effective amount of stabilizer which is sufficient to prevent the oxidative degradation of the lubricant at temperatures in excess of 200° C. The quantities of lubricant employed can vary depending upon the type of yarn, and the speed and complexity of the spinning operation. Generally, the amount employed will range from 0.2 to 5.0 weight percent based on the weight of the fiber. Preferably however, the amount of lubricant ranges from about 0.5 to 1.5 weight percent based on the weight of the fiber. It is necessary generally in processing fibers and finished products from those fibers that the lubricants employed in the manufacture of such fibers have sufficient oxidative stability that they will not decompose in the presence of air, forming decomposition products which would discolor the resulting yarn or fiber. There is also provided a process for lubricating synthetic fibers which comprises the treatment of such fibers with a composition which is sufficiently stable to undergo temperatures in excess of 200° C. without undergoing sufficient oxidation to impart color to the synthetic fibers. The lubricant is generally applied to the filaments upon their emergence from the spinning tower. The quantity of lubricant applied ranges from 0.2 to 5.0 weight percent based upon the weight of the fiber. Preferably, the amount of lubricant ranges from about 0.5 to 1.5 weight percent based on the weight of the fiber.

The lubricant may be selected from the group consisting of polyoxyalkylene ether polyols, alkoxylates of fatty alcohol, alkoxylates of fatty acids, and alkoxylates of lauryl mercaptan. The polyoxyalkylene ether compounds are selected from the group consisting of those which are represented by the following formula:

$$X[(C_3H_6O)_n\text{-}E\text{-}A]_x$$

wherein X is the residue of an organic compound containing therein $x$ active hydrogen atoms, and is an integer, $x$ is an integer greater than 1, the values of $n$ and $x$ are such that the molecular weight of the compound, exclusive of E, is at least 900, E is a polyoxyalkylene chain wherein the oxygen/carbon atom ratio is at least 0.5, and E constitutes 20 to 90% by weight of the compound. The compounds are more particularly defined in U.S. Pat. No. 2,674,619 which disclosure is incorporated herein by reference.

Another type of polyoxyalkylene ether compound may be represented by the formula:

$$Y(PK)_yH_y$$

wherein Y is the residue of an organic compound having Y reactive hydrogen and up to six carbon atoms, P is a hydrophobic polyoxyalkylene chain having an oxygen/carbon atom ratio of not more than 0.40, the molecular weight of P and the value of $y$ being such that the molecule excluding K as a molecular weight of at least about 400 to 900 and up to about 25,000 and K is a hydrophilic polyoxyalkylene chain which (1) contains oxyethylene groups and at least 5% by weight of higher molecular weight oxyalkylene groups having at least three carbon atoms in the structure, and (2) has an average oxygen/carbon atom ratio of greater than 0.40, K being present in the composition in an amount sufficient to constitute from about 10% to about 90% by weight of the total composition. These compounds are more particularly described in U.S. Pat. No. 3,101,374 which disclosure is incorporated herein by reference.

Still another class of lubricants are those described as $$R\text{—}O(A)_mH$$

wherein R is a straight chain alkyl group having from 8 to 20 carbon atoms, A is a mixture of oxypropylene and oxyethylene groups. The oxypropylene to oxyethylene ratio of said total weight being from 0.1 to 1 to 1.0 to 0.1, and *m* is an integer such that the oxyalkylene groups constitute 50 to 90% by weight of the compound. These compounds are prepared either by random addition of oxyalkylene groups or sequential addition thereof. A number of these compounds are more particularly defined in U.S. Pat. Nos. 3,340,309 and 3,504,041 which disclosures are incorporated herein by reference.

Another preferred class of fiber lubricants are the alkoxylates of lauryl mercaptan. The lauryl mercaptan is an alkoxylate addition product of oxyethylene and oxypropylene wherein the oxypropylene to oxyethylene ratio of said total weight being from 0.1 to 1 to 1.0 to 0.1 and *m* being an integer such that the oxyalkylene groups constitute from 50 to 90% by weight of the compound.

A further class of lubricants are those described as

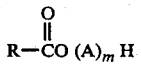

wherein R is an alkyl group having from 8 to 20 carbon atoms, A is a mixture of oxypropylene and oxyethylene groups, the oxypropylene to oxyethylene ratio being from 0.1 to 1.0 to 1.0 to 0.1 and *m* is an integer such that the oxyalkylene groups constitute 50 to 90% by weight of the compound. These compounds are prepared either by random addition of oxyalkylene groups or sequential addition thereof employing alkaline catalysts in a manner similar to those described in U.S. Pat. Nos. 3,340,309 and 3,504,041. The stabilizer is the reaction product which is formed by reacting in the presence of Friedel-Crafts type catalyst, one mole of dicyclopentadiene and at least one mole of p-cresol and further reacting with at least ½ mole of isobutylene. The quantities of stabilizer which may be employed ranges from about 0.1 to about 1.5 weight percent based on the weight of the lubricant. Preferably, however, the amount of stabilizer ranges from about 0.5 to 1.5 weight percent based on the weight of the lubricants. It is further contemplated that the process for lubricating synthetic fibers may employ a composition which consists essentially of a mixture of a major amount of the lubricant and a minor effective amount of said stabilizer which is sufficient to prevent the oxidative degradation of the lubricant at temperatures in excess of 200° C.

In accordance with the present invention, textile treating compositions are effectively stabilized by having incorporated herein a minor amount of a stabilizer prepared by a process which involves reacting one mole of dicyclopentadiene having the following structural formula

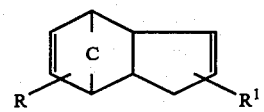

wherein R and $R^1$ are selected from the group consisting of hydrogen and methyl, with at least one mole of the phenolic compound selected from the group consisting of phenol, para-cresol, meta-cresol, para-ethyl phenol, and meta-ethyl phenol preferably in the presence of a Friedel-Crafts type catalyst. More specifically, the phenolic materials that are effectively reacted with the dicyclopentadiene in accordance with the first step of the present process may be defined as phenolic compounds conforming to the following structural formula:

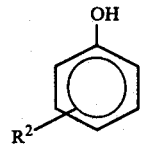

wherein $R^2$ is a radical selected from the group consisting of hydrogen, methyl, and ethyl and wherein $R^2$ is in a meta or para position. Preferred proportions of reactants in the resulting product are from 1.50 to 1.75 moles of phenolic compound per mole of the dicyclopentadiene. The reaction product of the dicyclopentadiene and phenolic compound is subsequently alkylated with at least one-half mole of a tertiary olefinic material per mole of the dicyclopentadiene, said tertiary olefinic material being selected from the group consisting of isobutylene, tertiary hexenes, and tertiary pentenes.

These two-stage reaction products are mixtures of compounds having the following structural formula:

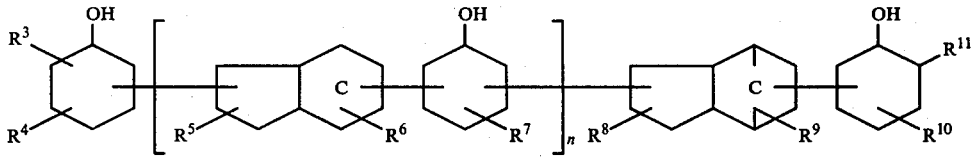

wherein $R^3$ and $R^{11}$ are tertiary alkyl radicals having from 4 to 6 carbon atoms and wherein $R^4$, $R^7$ and $R^{10}$ are selected from the group consisting of hydrogen, methyl, ethyl and tertiary alkyl radicals having from 4 to 6 carbon atoms and wherein $R^5$, $R^6$, $R^8$ and $R^9$ are selected from the group consisting of hydrogen and methyl and wherein *n* is 0 or a positive integer of 1, 2 or 3.

In the above list of compounds $R^3$ and $R^{11}$ may be selected to be the same or different. The same is true of $R^4$, $R^7$ and $R^{10}$ and $R^5$, $R^8$ $R^9$. The dicyclopentadiene variety and $R^3$, $R^4$, $R^7$, $R^{10}$ and $R^{11}$ may be attached to either the ortho, meta or para positions or the phenolic varieties, most preferably the ortho or para positions. Preferred compounds are those where tertiary alkyl groups are attached ortho to OH group.

The amount of olefinic material to be employed will depend upon the phenolic compound used and also upon the molar ratio of phenolic compound and the dicyclopentadiene in the reaction product. Thus the product prepared from phenol and dicyclopentadiene will react with more of the olefinic compound than the product from para-cresol. Also a reaction product of phenol containing a 2:1 molar ratio of phenol and dicyclopentadiene will react with more olefin than a 1:1 product.

The reaction between the dicyclopentadiene and the phenolic compounds is effectively catalyzed by a Friedel-Crafts type catalyst, and in particular the more potent Friedel-Crafts catalysts such as aluminum chloride, zinc chloride, ferrous and ferric chloride and boron trifluoride, as well as complexes based on boron trifluoride. Boron trifluoride and complexes based on boron trifluoride are preferred catalysts for the first step of the disclosed process. The second step of the above described two-step reaction process, wherein the product obtained by reacting the dicyclopentadiene and a phenolic compound is further alkylated with a tertiary olefin, is effectively catalyzed by employing one or more of the customary acidic alkylation catalysts such as sulfuric acid, benzene sulfonic acid, toluene sulfonic acid, acid activated clays, boron trifluoride, zinc chloride, ferrous and ferric halides, aluminum halides and the stannous and stannic halides. Sulfuric acid, benzene sulfonic acid, toluene sulfonic acid and acid activated clay are preferred catalysts for the second step of the disclosed process.

The reaction defined as step one of the disclosed two-step process wherein the dicyclopentadiene reacted with a phenolic compound is conducted at a temperature from 25° to 160° C. Preferred reaction temperatures are between 80° and 150° C. The reaction between the dicyclopentadiene and a phenolic compound may be started at room temperature and since the reaction is quite rapid and exothermic the heat of reaction may be used to obtain the final reaction temperature. If adequate cooling facilities are available the reaction may be carried out on a continuous basis.

The molar ratio of phenolic compound to the dicyclopentadiene employed in the reaction mixture of stage one of the disclosed process can be varied from 1:1 or 5 or more:1 mols of phenolic compound per mole of the dicyclopentadiene. The proportions usually employed range from 2:1 to 4:1 moles of phenolic compounds per mole of the dicyclopentadiene, a preferred ratio being 3:1.

Those synthetic fibers which it is contemplated may be treated with the textile treating compositions of the instant invention include polyester and polyamide fibers. The polyester fibers are those in which the fiber-forming substance is any long-chain synthetic polymer composed of at least 85% by weight of an ester of a dihydric alcohol and terephthalic acid. The polyamide fibers are those in which the fiber-forming substances are any long-chain synthetic polyamide having recurring amide groups as an integral part of the polymer chain.

The specific process conditions for the preparation of the stabilizer may be found in U.S. Pat. No. 3,751,375, the disclosure of which is incorporated herein by reference.

A guide for selecting the minimum required concentration of stabilizer for use in this invention will be found in the drawing which is a graph in which the percentage concentration of stabilizer is plotted against the temperature at which a 1 percent weight loss of lubricant occurs as determined by thermogravimetric analysis. The curve shows that the presence of stabilizer causes an increase of thermal stability of Polyol A, as defined infra, from less than 200° C. to greater than 250° C. Since normal fiber manufacture occurs at temperatures greater than 200° C. and less than about 250° C., satisfactory stability of the lubricant can be achieved.

The following Examples illustrate the invention.

EXAMPLES 1–18

Stability tests of various polyols containing stabilizers were performed by thermogravimetric analysis (TGA). The procedure employed was as follows:

In each test the polyol with and without the stabilizer as indicated in the table below, was tested by adding approximately 60 to 70 milligrams of the indicated polyol to the TGA pan of a DuPont 951 thermogravimetric analyzer. The sample was then heated at the rate of 10° C. per minute in air. The results were automatically recorded on charts. The temperature at which 1%, 5% and 10% weight loss occurred were determined from the chart. The polyols and stabilizers employed were as follows:

Polyol A is an adduct of a mixture of alcohols containing from 12 to 15 carbon atoms, with 59% propylene oxide and 25% ethylene oxide. The molecular weight of the polyol is about 1300.

Polyol B is a propylene glycol, propylene oxide, ethylene oxide adduct having a molecular weight of about 13,500, containing 80% ethylene oxide by weight.

Polyol C is a propylene glycol, propylene oxide, ethylene oxide adduct having a molecular weight of about 2200 containing about 45% ethylene oxide by weight.

Polyol D is an adduct of propylene oxide, ethylene oxide, and fatty alcohols containing from 12 to 16 carbon atoms. The polyol has a molecular weight of 1100 containing 60% by weight ethylene oxide, 20% propylene oxide by weight.

Polyol E is a propylene oxide, ethylene oxide adduct of lauryl mercaptan. Said polyol has a molecular weight of about 1400 containing 84% of a mixture of 65 to 35 ratio of propylene oxide to ethylene oxide respectively.

Stabilizer F is a butylated reaction product of p-cresol and dicyclopentadiene.

Stabilizer G is trilauryl trithiophosphite.

Table

| Example | Polyol | Stabilizer, % | Temperature of Weight Loss in Air, ° C 1% | 5% | 10% |
|---|---|---|---|---|---|
| 1 | A | — | 202 | 218 | 231 |
| 2 | A | 0.5* | 257 | 285 | 287 |
| 3 | A | 1.0* | 263 | 283 | 298 |
| 4 | A | 1.0** | 247 | 270 | 283 |
| 5 | A | 1.5*** | 247 | 267 | 283 |
| 6 | A | 1.5* | 255 | 273 | 297 |
| 7 | B | 0.5* | 246 | 260 | 271 |
| 8 | B | 1.0* | 254 | 265 | 274 |
| 9 | B | 1.5* | 269 | 286 | 297 |
| 10 | B | — | 206 | 228 | 242 |
| 11 | C | — | 189 | 210 | 222 |
| 12 | C | 0.5* | 227 | 246 | 258 |
| 13 | C | 1.0* | 243 | 258 | 270 |
| 14 | C | 1.5* | 252 | 273 | 288 |
| 15 | D | — | 195 | 231 | 251 |
| 16 | D | 1.0* | 260 | 284 | 303 |
| 17 | E | — | 210 | 253 | 279 |
| 18 | E | 1.0* | 245 | 308 | 327 |

*stabilizer F
**0.5% Stabilizer F + 0.5% Stabilizer G
***1.0% Stabilizer F + 0.5% Stabilizer G

EXAMPLE 19

Polycaprolactam polymer is fed into a screw extruder and heated to 275° C. Molten polymer is pumped under pressure of approximately 1700 psig through a sand filter and then through capillary of a spinnerette plate. Freshly extruded filaments are put through a descending spinning tower into which air of 70° F. temperature and 65° relative humidity is admitted. The filaments are gathered into yarn and upon emerging from the spinning tower are coated with a fiber lubricant solution to the extent that the lubricant is applied to the yarn at a rate of 0.75 weight percent based on the weight of the yarn. The yarn is then wound into a package at a rate of about 2000 feet per minute. The resulting yarn is then drawn over a $\frac{5}{8}$ inch diameter draw pin at a delivery rate of 1536 feet per minute during which time the yarn passed over a heater maintained at 175° C. The yarn is then heat cured employing an electric heater at 150° C. for 30 minutes to nylon carpet backing with a latex binder. Resulting carpet fiber does not display any color formation. The fiber lubricant employed is similar to that employed in Example 2 wherein the polyol is Polyol A containing 0.51 of stabilizer F. A similar carpet fiber prepared in a similar fashion without the use of the stabilized fiber lubricant, results in a carpet fiber having a distinct yellow coloration.

The embodiments of the invention in which an exclusive property or privilege is claimed are defined as follows:

1. A textile treating composition consisting essentially of a mixture of (1) a major amount of a lubricant and (2) a minor effective amount of stabilizer sufficient to prevent oxidative degradation of said lubricant upon exposure to heat said stabilizer a reaction product formed by reacting, in the presence of Friedel-Crafts type catalyst, one mole of dicyclopentadiene and at least one mole of p-cresol, and further reacting said reaction product with at least one half mole of isobutylene.

2. The composition of claim 1 wherein the amount of stabilizer ranges from about 0.1 to 1.5 weight percent based on the weight of the lubricant.

3. The composition of claim 1 wherein the amount of stabilizer ranges from about 0.5 to 1.5 weight percent based on the weight of the lubricant.

4. The composition of claim 1 wherein the lubricant is selected from the group consisting of polyoxyalkylene ether polyols, alkoxylates of fatty alcohols, alkoxylates of fatty acids, and alkoxylates of lauryl mercaptan.

5. The composition of claim 1 wherein the amount of lubricant ranges from about 0.2 to 5.0 weight percent based on the weight of the fiber.

6. The composition of claim 1 wherein the amount of lubricant ranges from abut 0.2 to 2.0 weight percent based on the weight of the fiber.

7. A synthetic polyamide or polyester fiber having deposited thereon the composition of claim 1.

8. A synthetic polyamide or polyester fiber having deposited thereon the composition of claim 2.

9. A synthetic polyamide or polyester fiber having deposited thereon the composition of claim 3.

10. A synthetic polyamide or polyester fiber having deposited thereon the composition of claim 4.

11. A synthetic polyamide or polyester fiber having deposited thereon the composition of claim 5.

12. A synthetic polyamide or polyester fiber having deposited thereon the composition of claim 6.

13. A process for lubricating synthetic fibers which comprises treating said fibers with a composition consisting essentially of a mixture of a major amount of a lubricant and a minor effective amount of stabilizer sufficient to prevent oxidative degradation of said lubricant at temperatures in excess of 200° C., said stabilizer a reaction product formed by reacting, in the presence of Friedel-Crafts type catalyst, one mole of dicyclopentadiene and at least one mole of p-cresol, and further reacting said reaction product with at least one half mole of isobutylene.

14. The process of claim 13 wherein the amount of stabilizer ranges from about 0.1 to 1.5 weight percent based on the weight of the lubricant.

15. The process of claim 13 wherein the amount of stabilizer ranges from about 0.5 to 1.5 weight percent based on the weight of the lubricant.

16. The process of claim 13 wherein the lubricant is selected from the group consisting of polyoxyalkylene ether polyols, alkoxylates of fatty alcohols, alkoxylates of fatty acids, and alkoxylates of lauryl mercaptan.

17. The process of claim 13 wherein the amount of lubricant ranges from about 0.2 to 5.0 weight percent based on the weight of the fiber.

18. The process of claim 13 wherein the amount of lubricant ranges from about 0.2 to 2.0 weight percent based on the weight of the fiber.

* * * * *